United States Patent [19]

Yee

[11] 4,053,260

[45] Oct. 11, 1977

[54] DOUBLE SPIDER STIFFENING ASSEMBLY FOR FAN BLADES

[75] Inventor: Clifford S. L. Yee, Indianapolis, Ind.

[73] Assignee: Wallace Murray Corporation, New York, N.Y.

[21] Appl. No.: 697,515

[22] Filed: June 18, 1976

Related U.S. Application Data

[63] Continuation of Ser. No. 550,657, Feb. 18, 1975, abandoned.

[51] Int. Cl.[2] ..... F04D 29/34

[52] U.S. Cl. ..... 416/210 R; 416/244 R; 416/DIG. 3

[58] Field of Search ..... 416/210, 214, 244, 245, 416/DIG. 3

[56] References Cited

U.S. PATENT DOCUMENTS

| | | | |
|---|---|---|---|
| 1,255,346 | 2/1918 | Sparks | 416/204 |
| 1,404,298 | 1/1922 | Jacobs | 416/244 |
| 1,634,554 | 7/1927 | Pajalic | 416/DIG. 3 X |
| 2,351,225 | 6/1944 | Patrick et al. | 416/210 |
| 2,906,349 | 9/1959 | Hans et al. | 416/212 X |
| 3,315,749 | 4/1967 | Parsons et al. | 416/214 X |

FOREIGN PATENT DOCUMENTS

| | | | |
|---|---|---|---|
| 972,802 | 2/1951 | France | 416/214 |
| 762,625 | 3/1954 | Germany | 416/244 |
| 861,734 | 1/1953 | Germany | 416/210 |
| 1,428,268 | 2/1969 | Germany | 416/244 |
| 417,232 | 10/1934 | United Kingdom | 416/210 |
| 908,586 | 10/1962 | United Kingdom | 416/204 |

*Primary Examiner*—Everette A. Powell, Jr.
*Attorney, Agent, or Firm*—Thomas J. Greer, Jr.

[57] ABSTRACT

A fan blade mounting employing two integral workpieces formed of sheet metal, each having a central hub portion and radially extending arms, the sheet metal arms of each are centrally bulged or ribbed in the region where they join the hub, the ribs facing in opposite directions to form a cavity in each two-part arm. The central hub portion of each workpiece is depressed from the plane of its arms, the hub portions being nested. Each spider arm is thus stiffened by the compressive loading within one rib when a transverse force is applied on the opposite arm.

2 Claims, 3 Drawing Figures

FIG. 1
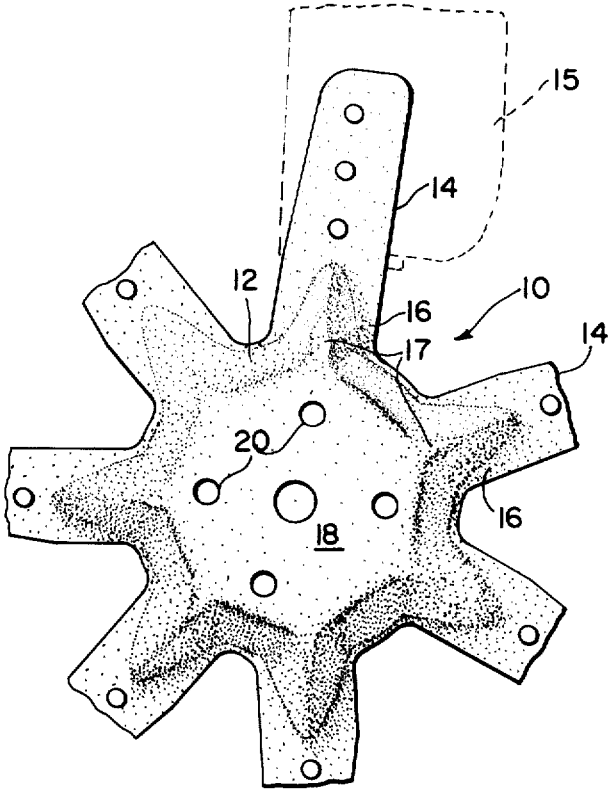
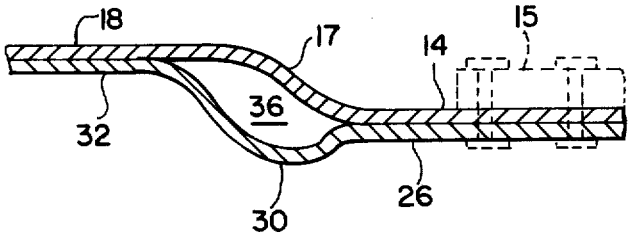
FIG. 3
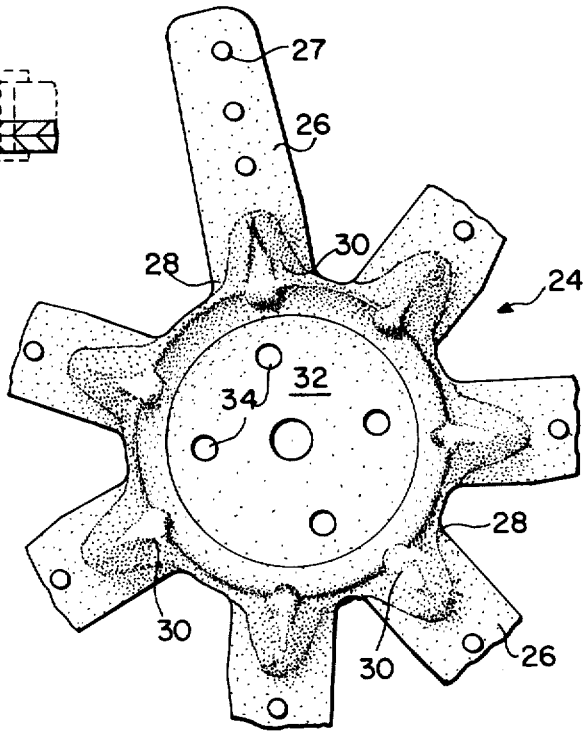
FIG. 2

DOUBLE SPIDER STIFFENING ASSEMBLY FOR FAN BLADES

This is a continuation of application Ser. No. 550,657 filed Feb. 18, 1975, now abandoned.

This invention relates to a fan construction for the cooling system of an internal combustion engine. Such fans are well known and are for the purpose of moving air over the coils of a radiator (heat exchanger) for cooling the water in the radiator system. A great variety of constructions for such fans are employed by those working in this art.

One type of fan construction employs a sheet metal hub with radiating fingers or arms to which sheet metal fan blades are mounted, and is shown by Wooden in U.S. Pat. No. 3,285,502. In U.S. Pat. No. 3,147,811 to Klonski, a single spider arm sheet workpiece is shown wherein the arms and hub are ribbed. In another and similar construction, shown by Wooden in U.S. Pat. No. 3,628,888, the sheet metal blades themselves form a sandwich for the ends of spider arms to which they are secured. In still another construction, the sheet metal fan blades are centrally ribbed and are juxtaposed with respect to complementary bosses on a hub member, as shown by Dilg in U.S. Pat. No. 1,121,335. While complementary rib and groove constructions are known, the use of a joint wherein the sheet metal arms are ribbed and face in opposite directions has until now not evolved.

According to the practice of this invention, a pair of sheet metal spider members have arms which sandwich or otherwise mount fan blades. The two sheet metal hub and spider elements are crimped in the region where the hub integrally joins the outwardly extending arms. The crimp in each of the two members is such that the concavities formed by the crimps face each other to thereby define a hollow zone or cavity just beneath the root of each fan blade, as opposed to the complementary rib and groove type already known. By virtue of this crimped or ribbed construction, the rigidity and resistance to flexing of the radially extending arms is increased.

IN THE DRAWINGS

FIG. 1 is a plan view of a partially crimped, ribbed sheet metal hub and spider arm, forming one side of a complete blade mounting assembly.

FIG. 2 is a plan view of another partially crimped, ribbed sheet metal hub and spider arm, forming the other half of a complete blade mounting assembly.

FIG. 3 is a partial cross-sectional view taken longitudinally along a typical arm assembly and midway thereof.

Referring now to FIG. 1 of the drawings, the numeral 10 denotes generally one sheet metal hub and spider arm assembly formed from an integral sheet metal workpiece. The numeral 12 denotes generally the hub portion and a number of integral and radially extending arms 14, only one of which is completely illustrated, extend outwardly. As shown by the phantom lines, a fan blade 15 of any desired construction is adapted to be secured to each of the arms 14 as by rivets in the indicated locations. The numeral 16 denotes generally the root portion of each blade 14, it being understood that the root portion is that region of the sheet metal workpiece connecting the arms 14 to the hub or central portion 12. Each root 16 is provided with an upwardly extending bulge or rib 17, formed into the sheet metal as by local deformation. The bulge is in a direction such that the bulge rises from the plane of the paper, i.e., towards the reader. The central portion 18 of the hub is also raised relative to the blades 14. The central portion 18 thus defines a plateau which decreases in elevation along any of the bulges 17 until at the radially outermost part of the bulges 17 the plane of the blades 14 is reached. The root portion 16 is in the plane of the blades 14. The numeral 20 denotes conventional mounting apertures for fastening the hub to a rotating shaft.

Referring now to FIG. 2 of the drawings, a complementary sheet metal workpiece member 24 is illustrated having a plurality of radially extending and integral arms 26, only one of which is shown. Again, each arm may be provided with a plurality of apertures, such as 27, which are adapted to receive fasteners such as rivets for attachment of a fan blade to each arm 26. Again, only one arm is completely illustrated. The numeral 28 indicates the arm root portion. The numeral 30 denotes a bulge or rib in the root portion of each arm and may be formed by embossing or other local deformation. The central, hub portion 32 of sheet metal member 24 is depressed and extends below the plane of the paper as viewed by the reader. Again conventional mounting apertures such as 34 are provided.

The workpiece assemblies indicated at FIGS. 1 and 2 of the drawings are now placed together, with the concave portion 32 of workpiece 24, shown at FIG. 2, being received in the complementary concave portion on the other side of workpiece 10 of FIG. 1. Thus, portions 18 and 32 are nested and may contact one another. The two workpieces are held together by fastening elements on their arms, conveniently the same elements employed to affix the fan blades. The apertures 20 and 34 are now aligned, ready for subsequent fastening to a rotary shaft adjacent the radiator. This arrangement is shown at FIG. 3 wherein a partial longitudinal cross-section taken along any of the arms and substantially midway thereof is illustrated. The blade mounting arms 14 and 26 of the workpieces are superimposed and may contact each other, similar to the central portions 18 and 32, with a cavity 36 being defined by oppositedly bulged or ribbed portions 17 and 30 for each two-part arm. It will be understood that each cavity 36 is defined only at the central portion of the base of each blade of the composite blade member, as indicated at FIG. 3, because the bulges or ribs 17 and 30 are positioned only at the central portions of their respective blade roots. A typical fan blade 15 of any desired configuration is, again, indicated by dashed lines at FIGS. 3. If desired, the double-thickness spider arms may be twisted in the region of their integral connections to the hub portions of the composite fan mounting spider. The blade mounting arms 14 and 26 may also be separated to accept a fan blade between the arms. Similarly, a spacing element may be placed between the central portions 18 and 32 to space them. As shown at FIG. 3, the two hubs are nested, and are displaced axially from the arms 14, 26.

From the above description, the reader will easily comprehend that the axis of rotation of the fan mounting member above described is to the left of FIG. 3. Also, FIG. 1 may be considered a view looking down onto FIG. 3. FIG. 2 may be considered a view looking upward from beneath FIG. 3.

What is claimed is:

1. A fan blade spider arm mounting assembly of the type including hub and spider arm sheet metal workpieces for mounting fan blades, wherein the mounting assembly is defined by two sheet metal workpieces, each having integral angularly spaced fan blade mounting arms joined to a central hub portion at the root of each arm, the workpieces angularly aligned and in superimposed relation, to thereby define double-thickness hub and spider arm portions, an outwardly extending rib at the root portion of each spider arm, the ribs of one workpiece oppositely facing the ribs of the other workpiece to thereby define a closed cavity at each spider arm root portion, the cavities being of lesser width than the width of the spider arms, the hubs and arms of the two workpieces being in abutting, facing relation to each other, the two workpieces being fastened to each other at their arms radially outwardly of said root portions, whereby each spider arm is stiffened by both compressive and tensile loading of its corresponding cavity walls when a transverse force is applied to that arm.

2. The fan blade spider arm mounting assembly of claim 1 wherein the double-thickness hub portion of the mounting assembly lies in a plane axially displaced and parallel to a plane which contains the radially outermost portions of said spider arms.

* * * * *